US010214899B2

(12) United States Patent
Bishop et al.

(10) Patent No.: US 10,214,899 B2
(45) **Date of Patent: *Feb. 26, 2019**

(54) HANDRAIL FOR STAIRCASE OR RAMP

(71) Applicants: Paul Bishop, San Diego, CA (US); James Boyd Shaible, San Marcos, CA (US)

(72) Inventors: Paul Bishop, San Diego, CA (US); James Boyd Shaible, San Marcos, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/597,715

(22) Filed: May 17, 2017

(65) Prior Publication Data

US 2018/0119414 A1 May 3, 2018

Related U.S. Application Data

(60) Continuation of application No. 15/089,209, filed on Apr. 1, 2016, now Pat. No. 9,790,679, which is a division of application No. 12/834,833, filed on Jul. 12, 2010, now Pat. No. 9,334,656, application No. 15/597,715, filed on May 17, 2017, which is a continuation of application No. 15/089,220, filed on Apr. 1, 2016, now Pat. No. 9,663,942, which is a division of application No. 12/834,833, filed on Jul. 12, 2010, now Pat. No. 9,334,656.

(51) Int. Cl.
*E04B 1/72* (2006.01)
*E04F 11/18* (2006.01)

(52) U.S. Cl.
CPC ..... *E04B 1/72* (2013.01); *E04F 11/18* (2013.01); *E04F 2011/1868* (2013.01)

(58) Field of Classification Search
CPC ... E04F 11/18; E04F 11/1863; E04F 11/1808; E04F 11/1812; E04F 11/1817; E04F 2011/1806; E04F 2011/1868; E04B 1/72
USPC ..... 52/182, 184, 187, 173.1, 832, 698, 27, 52/726.1; 256/59–72
See application file for complete search history.

(56) References Cited

U.S. PATENT DOCUMENTS 9,334,656 B2 * 5/2016 Bishop ..... E04F 11/18
9,663,942 B2 * 5/2017 Bishop ..... E04L 31/72
9,790,679 B2 * 10/2017 Bishop ..... E04L 31/72

* cited by examiner

*Primary Examiner* — Theodore V Adamos

(57) ABSTRACT

An improved handrail for a staircase or ramp. In one embodiment, the handrail includes an elongated member such as a cylinder or bar that spans the length of the staircase or ramp and a riser barrier. The riser barrier has an extender portion and a riser portion. The extender portion of the riser barrier keeps the elongated member a sufficient distance horizontally from the riser portion that a person can slide his or her hand on the rail without interference. The riser portion projects vertically a sufficient distance above the elongated member to deter sliding down the elongated member. Thus, sliding on the member is deterred, while the function of the cylinder as a handrail is preserved.

19 Claims, 6 Drawing Sheets

HANDRAIL FOR STAIRCASE OR RAMP

CROSS-REFERENCE TO RELATED APPLICATIONS

This application claims the benefit of U.S. application Ser. No. 15/089,220, filed on Apr. 1, 2016, and U.S. application Ser. No. 15/089,209, filed on Apr. 1, 2016, both of which are divisional applications of U.S. application Ser. No. 12/834,833, filed on Jul. 12, 2010, and titled "HANDRAIL FOR STAIRCASE OR RAMP", which issued on May 10, 2016 as U.S. Pat. No. 9,334,656 B2, titled "HANDRAIL FOR STAIRCASE OR RAMP".

FIELD OF THE INVENTION

The present invention relates generally to handrails for staircases or ramps, and more particularly to handrails that deter the use of the handrail as a slide.

DESCRIPTION OF THE RELATED ART

Many parks and public areas have staircases or ramps permitting easier navigation from one level to another in the park or public area. Typically, staircases 10 shown in FIG. 1 have handrails 20 on their sides and some in the center as well. Handrails must conform to certain standards so that a person can hold on to them while navigating up or down the stairs. However, handrails have the unintended consequence of providing a convenient track for skateboarders. As shown in FIG. 1, skateboarders 30 jump their skateboard 40 onto these rails 20 and slide down, possibly damaging the rail or making it unfit for its intended purpose. It would be desirable to curb the actions of skateboarders. Thus, there is a need for a modification of the handrail that would permit people to use it for guiding and stabilizing themselves as they use the staircase or ramp, while at the same time deterring skateboarders from using the handrail.

BRIEF SUMMARY OF THE INVENTION

Embodiments described herein address the aforementioned need. Embodiments modify a conventional handrail in a way that preserves its function, while at the same time preventing or deterring its use by skateboarders.

One embodiment is a plurality of riser barriers for a handrail of a staircase or ramp, where the handrail is an elongated member supported at a height above the staircase or ramp by a plurality of external supports. Each riser barrier of the plurality of riser barriers includes an extender portion and a riser portion. The plurality of riser barriers are solely supported by the elongated member at a first set of spaced-apart locations along the elongated member, and the plurality of external supports support the elongated member at a second set of spaced-apart locations along the elongated member. Each of the extender portions has a length between a proximal end and a distal end, where each of the proximal ends is fastened to the elongated member, and each of the distal ends is fastened to a respective riser portion at a position below the height of the elongated member. The length of each of the extender portions holds each respective riser portion a horizontal distance away from the elongated member to permit passage of a hand along the elongated member, and each of the riser portions has a length that extends above the elongated member so as to deter sliding along the elongated member.

Another embodiment includes a plurality of riser barriers for a handrail of a staircase or ramp, where the handrail being an elongated cylinder supported at a height above the staircase or ramp by a plurality of external supports. Each riser barrier of the plurality of riser barriers includes an arcuate-shaped member having an arc length between a proximal end and distal end, where each of the proximal ends is fastened to the elongated cylinder. The arc length of each of the riser barriers is such as to hold the riser barrier a horizontal distance away from the elongated cylinder to permit passage of a hand along the elongated cylinder and to have the distal end extend above the elongated cylinder so as to deter sliding along the elongated cylinder. The plurality of riser barriers are solely supported by the elongated cylinder at a first set of spaced-apart locations along the elongated cylinder, and the plurality of external supports support the elongated cylinder at a second set of spaced-apart locations along the elongated cylinder.

BRIEF DESCRIPTION OF THE DRAWINGS

These and other features, aspects and advantages of the present invention will become better understood with regard to the following description, appended claims, and accompanying drawings where:

DETAILED DESCRIPTION OF THE INVENTION

Embodiments include a modified handrail 100 that prevents a skateboarder from using the handrail. An impediment or barrier is attached that preserves the functionality of the handrail while at the same time deterring its use by the skateboarder.

Figure 1:
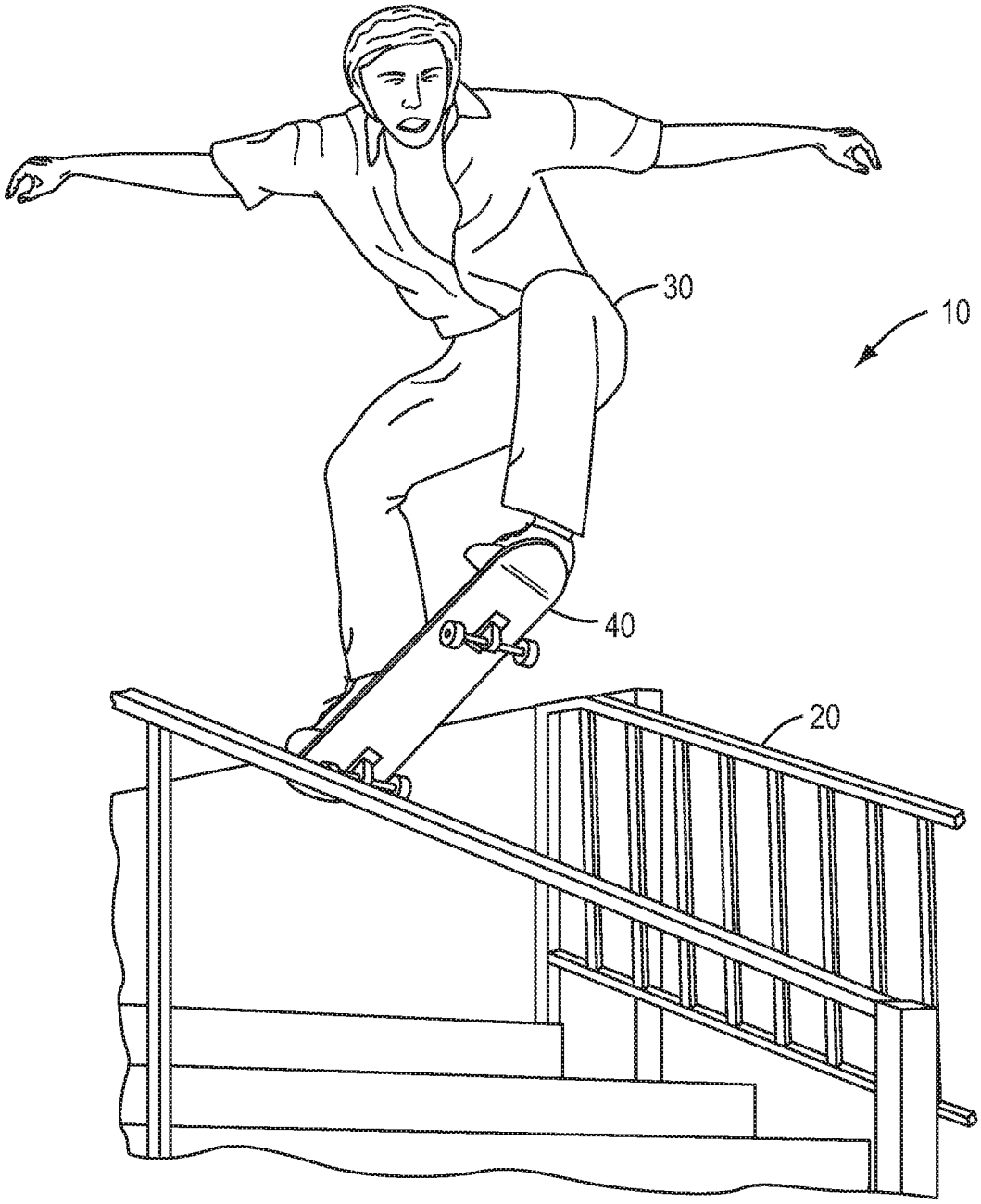
FIG. 1 depicts a skateboarder using the handrail as a slide.
Figure 2:
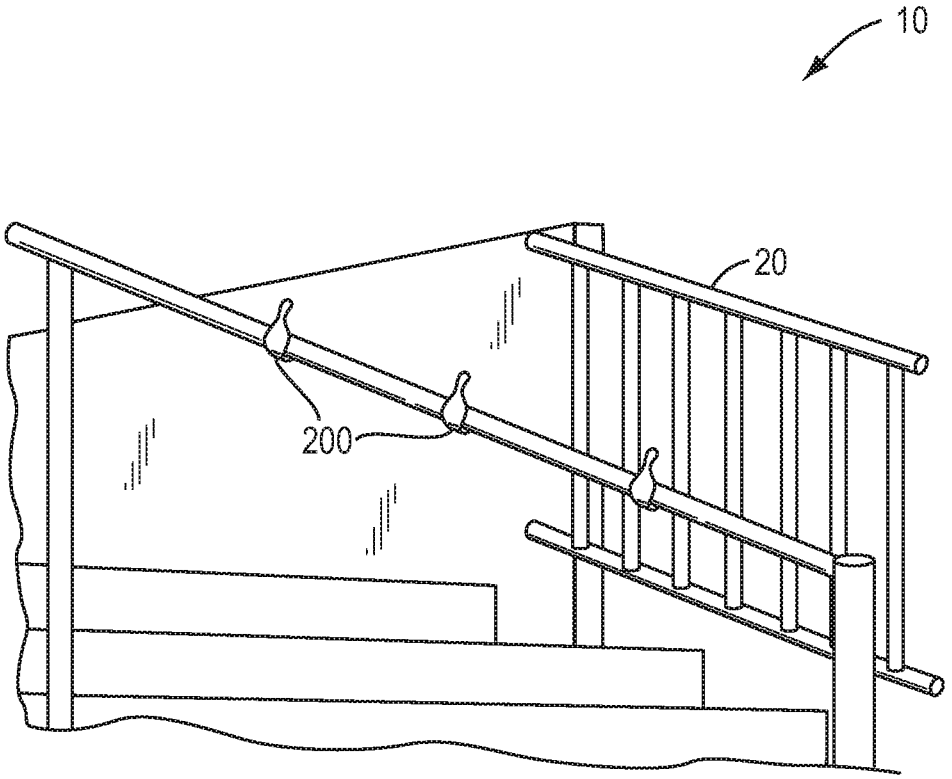
FIG. 2 depicts a staircase employing an embodiment of the present invention.
Figure 3A:
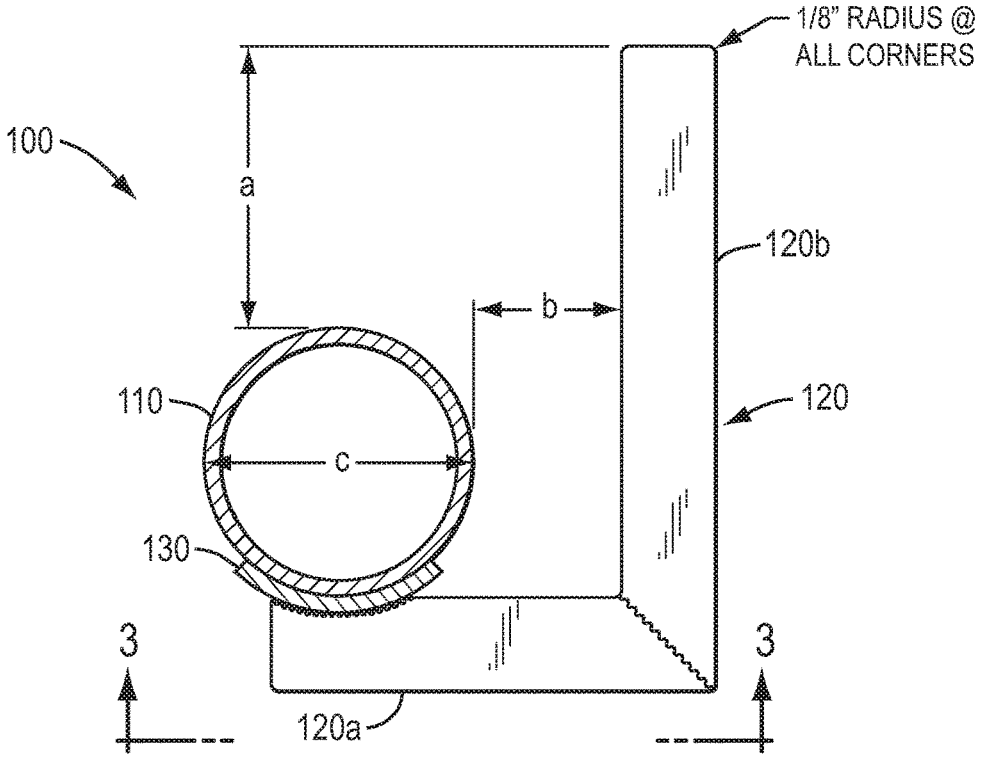
FIG. 3A depicts a transverse elevational view showing a first embodiment of the present invention.
Figure 3B:
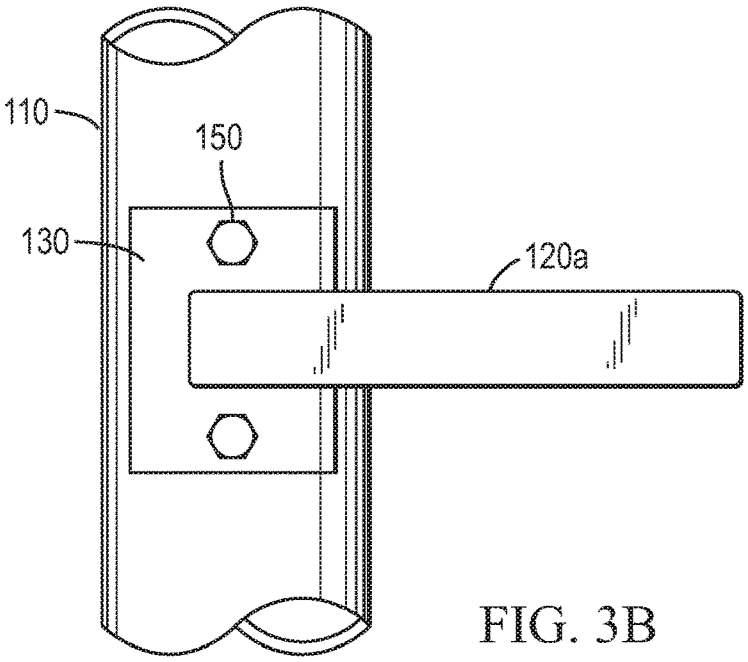
FIG. 3B depicts a bottom plan view of the embodiment shown in FIG. 3A.

The embodiment in FIGS. 3A and 3B includes an elongated cylinder 110, and a riser barrier 120 with extender portion 120*a* and a riser portion 120*b*. The elongated cylinder 110 spans the distance of the staircase 10 and is held up by vertical supporting members 22 (see FIG. 2) whose centers are spaced at approximately 48 inches. The extender portion 120*a* of the riser barrier 120 includes an arcuate portion 130 that is fastened to the elongated cylinder 110 using such fastening devices 150 such as bolts or rivets shown in FIG. 3. The riser portion 120*b* has a length that exceeds the thickness of the extender portion 120*a* plus the diameter "c" of the elongated cylinder by dimension "a". In one embodiment, dimension "a" is about 3 inches and dimension "c" is about 1½ inches. The extender portion

120*a* has a length that assures the elongated cylinder 110 spaced away from the riser portion 120*b* by dimension "b", which, in one embodiment, is about 1½ inches. Preferably, the riser barrier has ⅛ inch radius at all corners. The dimension "b" is sufficient to permit a user to slide his or her hand along the cylinder without interference, while the dimension "a" is sufficient to deter sliding on the cylinder.

Figure 4A:
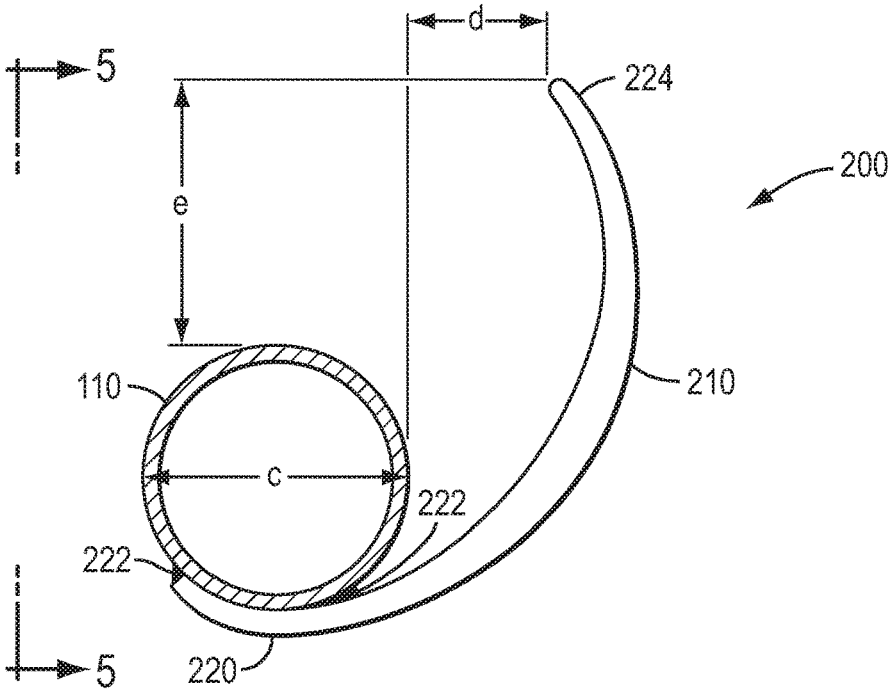
FIG. 4A depicts a transverse elevational view showing a second embodiment of the present invention.
Figure 4B:
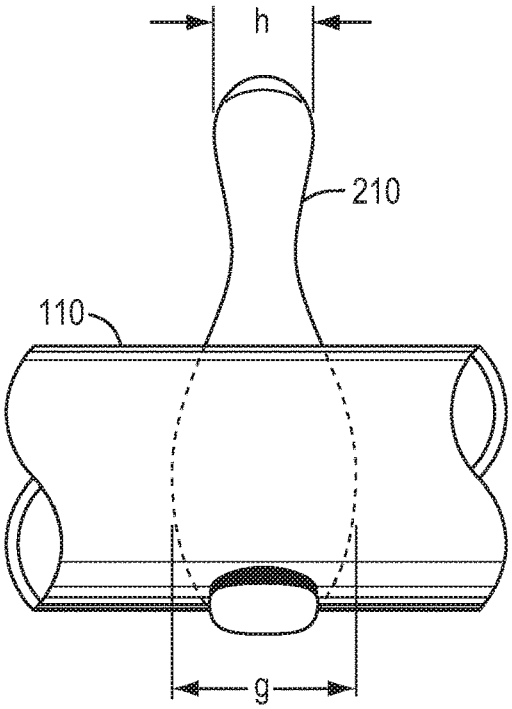
FIG. 4B depicts a left transverse elevational view of the embodiment shown in FIG. 4A.

The embodiment 200 in FIG. 4A and FIG. 4B includes an elongated cylinder 110 and an arcuate riser barrier 210 with a proximal end 220 and a distal end 224. The proximal end 220 is adapted for affixation to the bottom of the elongated cylinder 110 by conforming its curvature approximately to the curvature at the bottom of the elongated cylinder. The proximal end 220 is affixed to the elongated cylinder 110 by means of tack welds 222 at points on either side of the cylinder 110 nearest to the proximal end 220 of the barrier 210. The arcuate riser barrier 210 extends laterally and rises vertically so that the distal end 224 is spaced horizontally away from the elongated cylinder 110 by dimension "d", and vertically away by dimension "e". In one version, dimension "d" is approximately 1½ inches and dimension "e" is approximately 3 inches. As the arcuate riser barrier 210 rises from its proximal end 220 to its distal end, the riser barrier widens and then narrows. The arc-shaped arm has dimension "g" at its widest point and dimension "h" at its distal end. In one embodiment, dimension "g" is about 1½ inches and dimension "h" is about ¾ inches. Dimension "d" is sufficient to permit a user to slide his or her hand along the cylinder without interference while dimension "e" is sufficient to deter sliding on the cylinder.

Figure 5B:
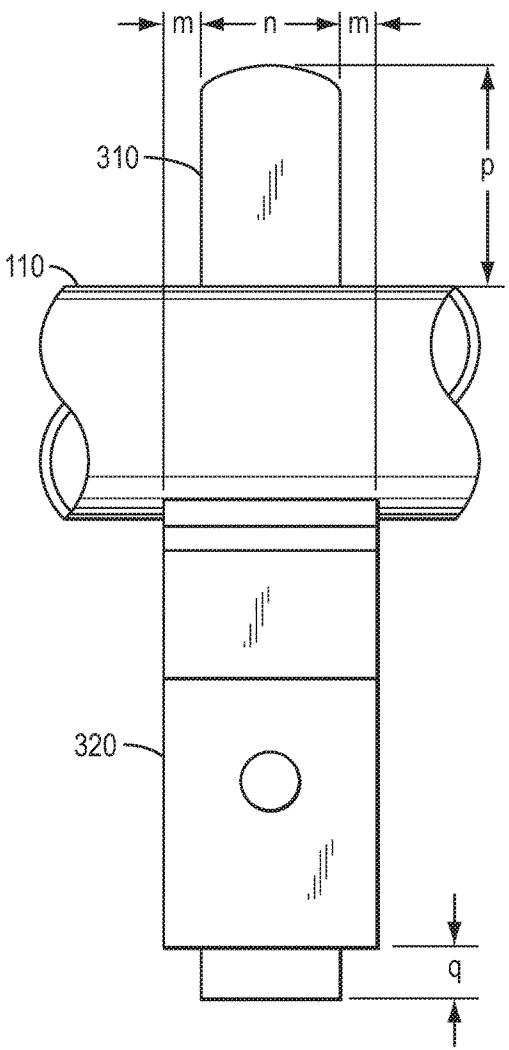
FIG. 5B depicts a right transverse elevational view of the embodiment shown in FIG. 5A.
Figure 5A:
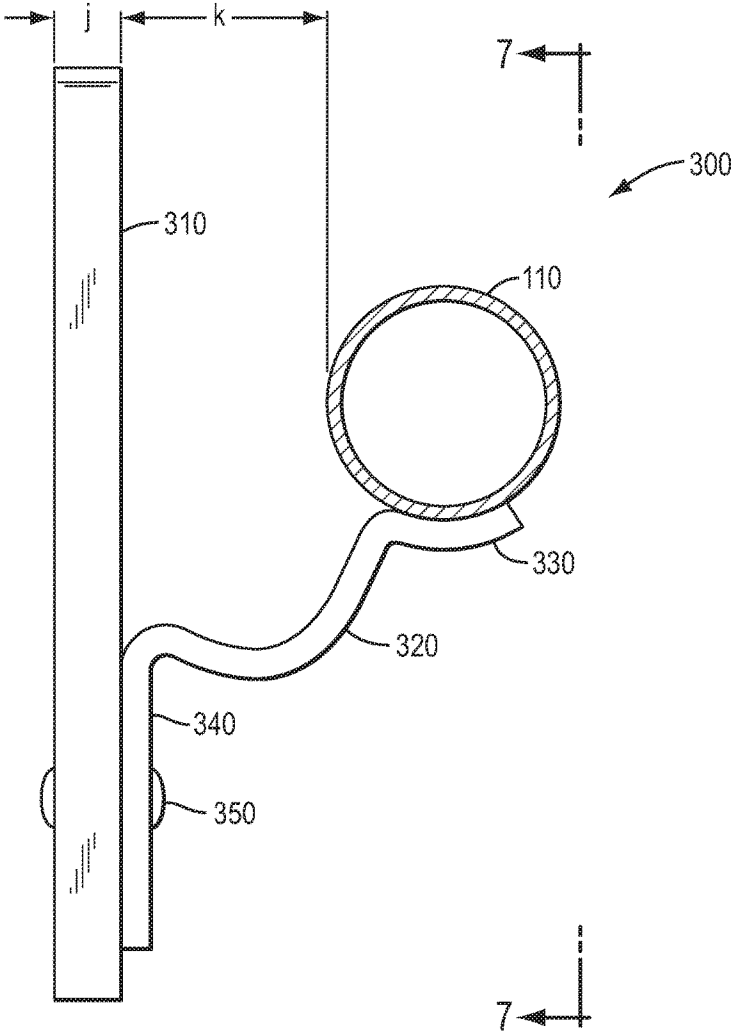
FIG. 5A depicts a transverse elevational view showing a third embodiment of the present invention.

The embodiment 300 in FIGS. 5A and 5B includes an elongated cylinder 110, and a riser barrier having extender portion 320 and riser portion 310. The extender portion 320 is curved downward between the proximal end 330 and the distal end 340 and holds the elongated cylinder 110 away horizontally from the riser portion 310 by dimension "k" and vertically away by dimension "p", where, in one embodiment, dimension "k" is about 1½ inches and dimension "p" is about 1½ inches. The horizontal separation between the riser portion 310 and cylinder 110 permits the user to slide his/her hand along the cylinder 110 without interference, the downward curve of the extender portion 320 giving added room for the user's hand. The length of the riser portion 310 deters the skateboarder from sliding on the rail. As shown in the figures, the riser portion 310 has a thickness given by dimension "j", which in one version is about ½ inch and a width given by dimension "n", which in one version is about 1 inch. The proximal end 330 of the extender portion 320 is generally arc-shaped to conform and attach to the curvature of the elongated cylinder 110. The distal end 340 of the extender portion 320 includes a generally flat, rectangular vertical portion. The flat, rectangular vertical portion fastens to the riser portion 310 and being wider than the riser portion 310 has a dimension of "m" by which it overlaps on either side the riser portion 310. In one version, dimension "m' is about ⅜ inch. Any fastening device 350, such as a bolt or rivet can be used to connect the flat portion of the distal end 340 to the riser portion 310. The riser portion extends by dimension "q" below the flat portion 340 of the extender portion 320. In one version, dimension "q" is about ½ inch.

Figure 6B:
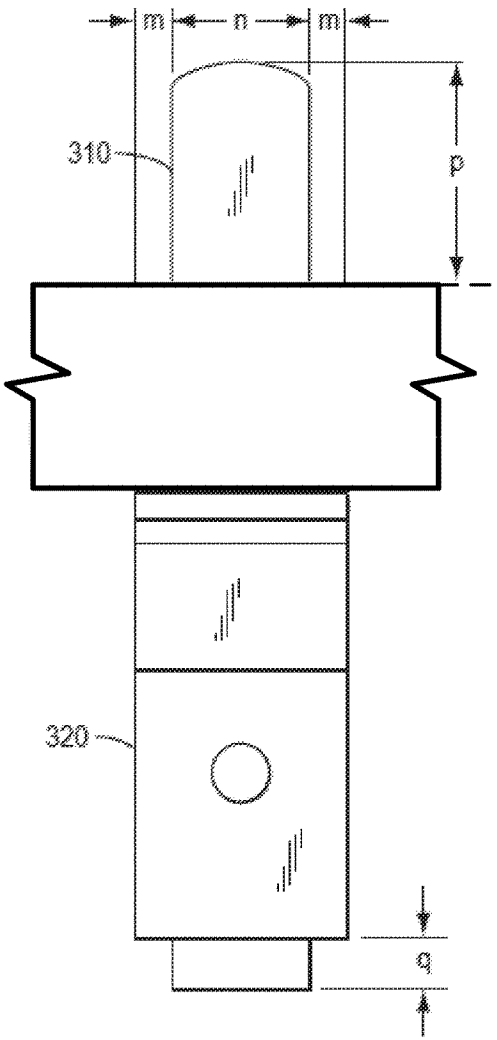
FIG. 6B depicts a right transverse elevational view of the embodiment shown in FIG. 6A.
Figure 6A:
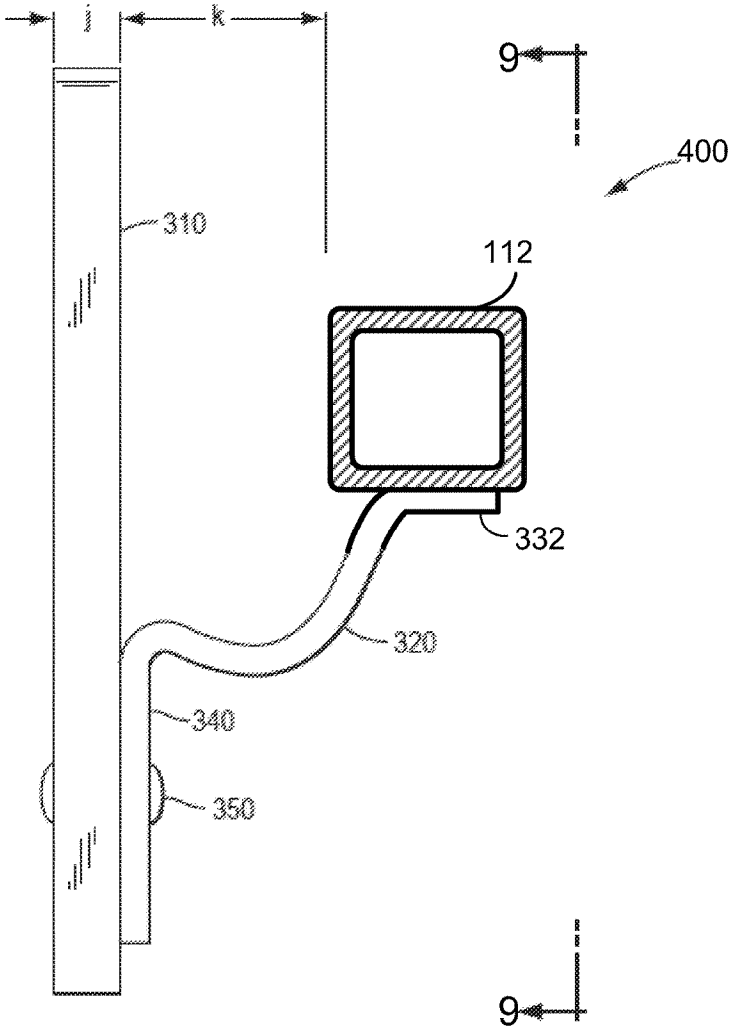
FIG. 6A depicts a transverse elevational showing a fourth embodiment of the present invention.

The embodiment 400 in FIGS. 6A and 6B includes an elongated bar 112 and a riser barrier having extender portion 320 and riser portion 310. The elongated bar 112 is generally rectangular or square in cross-section and may be hollow (shown) or solid. The extender portion 320 of the riser barrier is curved downward between the proximal end 332 and the distal end 340 and holds the elongated bar 112 away horizontally from the riser portion 310 by dimension "k" and vertically away by dimension "p", where, in one embodiment, dimension "k" is about 1½ inches and dimension "p" is about 1½ inches. The horizontal separation between the riser portion 310 and bar 112 permits the user to slide his/her hand along the bar 112 without interference, the downward curve of the extender portion 320 giving added room for the user's hand. The length of the riser portion 310 deters the skateboarder from sliding on the rail. As shown in the figures, the riser portion 310 has a thickness given by dimension "j", which in one version is about ½ inch and a width given by dimension "n", which in one version is about 1 inch. The proximal end 332 of the extender portion 320 is generally flat to conform and attach to the bottom of the bar 112. The distal end 340 of the extender portion 320 includes a generally flat, rectangular vertical portion. The flat, rectangular vertical portion fastens to the riser portion 310 and being wider than the riser portion 310 has a dimension of "m" by which it overlaps on either side the riser portion 310. In one version, dimension "m' is about ⅜ inch. Any fastening device 350, such as a bolt or rivet can be used to connect the flat portion of the distal end 340 to the riser portion 310. The riser portion extends by dimension "q" below the flat portion 340 of the extender portion 320. In one version, dimension "q" is about ½ inch.

In all of the above embodiments, the elongated cylinder or bar and riser barrier are fabricated with a material suited for environment in which the staircase or ramp is present. For example, if the staircase or ramp is outside in the elements, the elongated cylinder or bar and riser barrier may be fabricated in steel. Unless specified otherwise, the steel used has a suitable thickness to prevent bending or breakage. Suitable products that can be used for either the cylinder or bar are rectangular, square or round structural steel tubing such as HSS tubing. For round tubing, a length of 1.660× 0.140 structural tubing is sufficient. For rectangular tubing, a length of 2×1.5×⅛ inch tubing is sufficient. Suitable products that can be used for the extender portion are brackets, such as the round saddle bracket 1970R, 1978R, 1990R, 1998R, or flat saddle bracket 1970F, 1978F, 1990F, 1998F, manufactured by The Wagner Companies.

Although the present invention has been described in considerable detail with reference to certain preferred versions thereof, other versions are possible. Therefore, the spirit and scope of the appended claims should not be limited to the description of the preferred versions contained herein.

What is claimed is:

1. A plurality of riser barriers for a handrail of a staircase or ramp, the handrail being an elongated member supported at a height above the staircase or ramp by a plurality of external supports, each riser barrier of the plurality of riser barriers comprising:

an extender portion; and a riser portion, wherein the plurality of riser barriers are solely supported by the elongated member at a first set of spaced-apart locations along the elongated member, wherein the plurality of external supports support the elongated member at a second set of spaced-apart locations along the elongated member, wherein each of the extender portions has a length between a proximal end and a distal end, each of the proximal ends being fastened to the elongated member, each of the distal ends being fastened to a respective riser portion at a position below the height of the elongated member, wherein the length of each of the extender portions holds each respective riser portion a horizontal distance away from the elongated member to permit passage of a hand along the elongated member, and wherein each of the riser portions has a length that extends above the elongated member so as to deter sliding along the elongated member.

2. The plurality of riser barriers for a handrail, as recited in claim 1, wherein the elongated member is a cylinder, wherein each riser portion is generally vertical, wherein each extender portion is generally horizontal and has an arcuate portion at the proximal end that is adapted to the curvature at the bottom of the cylinder, and wherein the arcuate portion is fastened to the elongated cylinder.

3. The plurality of riser barriers for a handrail, as recited in claim 2, wherein the arcuate portion is fastened to the cylinder by bolts.

4. The plurality of riser barriers for a handrail, as recited in claim 2, wherein the arcuate portion is fastened to the cylinder by rivets.

5. The plurality of riser barriers for a handrail, as recited in claim 1, wherein the horizontal distance is approximately 1½ inches.

6. The plurality of riser barriers for a handrail, as recited in claim 1, wherein the elongated member is a cylinder, wherein each of the riser portions is generally vertical, and wherein each of the extender portions has a generally vertically downwardly curved portion between respective proximal and distal ends, each of the proximal ends having an arcuate shape that is adapted to the curvature at the bottom of the cylinder and each of the distal ends having a flat rectangular vertical portion that fastens to a respective riser portion.

7. The plurality of riser barriers for a handrail, as recited in claim 6, wherein each of the flat rectangular vertical portions is fastened with a bolt to a respective riser portion.

8. The plurality of riser barriers for a handrail, as recited in claim 6, wherein each of the flat rectangular vertical portions horizontally overlaps either side of a respective riser portion.

9. The plurality of riser barriers for a handrail, as recited in claim 1, wherein the elongated member is a bar, wherein each of the riser portions is generally vertical, and wherein each of the extender portions has a generally vertically downwardly curved portion between the proximal and distal ends, the proximal end having a flat shape that is adapted to the bottom of the bar and the distal end having a flat rectangular vertical portion that fastens to the riser portion.

10. The plurality of riser barriers for a handrail, as recited in claim 9, wherein each of the flat rectangular vertical portions is fastened with a bolt to each of the riser portions.

11. The plurality of riser barriers for a handrail, as recited in claim 9, wherein each of the flat rectangular vertical portions horizontally overlaps either side of each of the riser portions.

12. The plurality of riser barriers, as recited in claim 1, wherein the elongated member is a cylinder; and wherein the elongated cylinder has an outer diameter of about 1½ inches.

13. The plurality of riser barriers, as recited in claim 1, wherein the elongated member is a cylinder; and wherein the elongated cylinder and riser barriers are made from steel.

14. The plurality of riser barriers, as recited in claim 1, wherein the elongated member is a bar.

15. The plurality of riser barriers, as recited in claim 1, wherein the elongated member is a bar with a generally square or rectangular cross-section.

16. A plurality of riser barriers for a handrail of a staircase or ramp, the handrail being an elongated cylinder supported at a height above the staircase or ramp by a plurality of external supports, each riser barrier of the plurality of riser barriers comprising:

an arcuate-shaped member having an arc length between a proximal end and distal end, each of the proximal ends being fastened to the elongated cylinder, wherein the arc length of each of the riser barriers is such as to hold the riser barrier a horizontal distance away from the elongated cylinder to permit passage of a hand along the elongated cylinder, and to have the distal end extend above the elongated cylinder so as to deter sliding along the elongated cylinder, wherein the plurality of riser barriers are solely supported by the elongated cylinder at a first set of spaced-apart locations along the elongated cylinder, and wherein the plurality of external supports support the elongated cylinder at a second set of spaced-apart locations along the elongated cylinder.

17. The plurality of riser barriers, as recited in claim 16, wherein each riser barrier has a curvature at the proximal end being adapted to the curvature at the bottom of the elongated cylinder so as to allow attachment of the elongated cylinder to the proximal end on either side of the elongated cylinder.

18. The plurality of riser barriers, as recited in claim 17, wherein each riser barrier is attached to the elongated cylinder is by tack welds on either side of the elongated cylinder.

19. The plurality of riser barriers, as recited in claim 17, wherein each riser barrier has a width between the proximal and distal ends that is greater than at a width at either end.

* * * * *